US005494362A

United States Patent [19]

Kobayashi et al.

[11] Patent Number: 5,494,362

[45] Date of Patent: Feb. 27, 1996

[54] THERMAL TRANSFER PRINTER AND INK RIBBON CASSETTE FOR USE IN TRANSFER PRINTER

[75] Inventors: Hiroshi Kobayashi, Tamayama; Ikuo Hibino, Takizawa; Takahito Maruyama, Morioka; Fumihisa Hori, Takizawa; Tadashi Nakamura; Takanobu Matsuura, both of Morioka; Chikashi Ohsakama, Iwate, all of Japan

[73] Assignee: Alps Electric Co., Ltd., Tokyo, Japan

[21] Appl. No.: 208,549

[22] Filed: Apr. 12, 1994

Related U.S. Application Data

[62] Division of Ser. No. 40,777, Mar. 31, 1993, Pat. No. 5,429,443.

[30] Foreign Application Priority Data

| | | | |
|---|---|---|---|
| Apr. 6, 1992 | [JP] | Japan | 4-20591 U |
| Apr. 23, 1992 | [JP] | Japan | 4-104539 |
| Apr. 23, 1992 | [JP] | Japan | 4-104540 |
| Jun. 15, 1992 | [JP] | Japan | 4-155167 |
| Jul. 23, 1992 | [JP] | Japan | 4-51927 U |
| Jul. 31, 1992 | [JP] | Japan | 4-205262 |
| Aug. 20, 1992 | [JP] | Japan | 4-221467 |

[51] Int. Cl.[6] ..... B41J 35/28

[52] U.S. Cl. ..... 400/208; 400/207; 242/344; 242/357

[58] Field of Search ..... 400/207 E, 207, 400/208; 242/335, 338, 344, 357

[56] References Cited

U.S. PATENT DOCUMENTS 4,858,848 8/1989 Katoku et al. ..... 242/344

FOREIGN PATENT DOCUMENTS 62-039271 2/1987 Japan ..... 400/207 E

*Primary Examiner*—David A. Wiecking
*Attorney, Agent, or Firm*—Guy W. Shoup; Patrick T. Bever

[57] ABSTRACT

A ribbon cassette of which the type of ink ribbon accommodated in the ribbon cassette may be identified by diagonally-arranged detection switches arranged on the carriage of a thermal transfer printer, without using a plurality of types of ribbon cassette case which are different in shape.

3 Claims, 9 Drawing Sheets

THERMAL TRANSFER PRINTER AND INK RIBBON CASSETTE FOR USE IN TRANSFER PRINTER

This application is a division of application Ser. No. 08/040,777, filed Mar. 31, 1993, now U.S. Pat. No. 5,429,443 issued Jul. 4, 1995.

BACKGROUND OF THE INVENTION (1) Field of the Invention

The present invention relates to an ink ribbon cassette for use in a thermal transfer printer in which the ink on an ink ribbon is melted and transferred by means of selective heating of heat producing elements of a thermal head thereof to perform desired printing, and also relates to a feed mechanism of such ink ribbon in a thermal transfer printer.

(2) Description of the prior art

In a conventionally known thermal transfer printer, a recording medium such as a sheet of paper or the like and an ink ribbon having a desired ink applied on a base material which is formed of a resinous film are supported in front of a platen. A thermal head having a plurality of linearly arranged heat producing elements are mounted on a carriage. The ink ribbon is transported while reciprocating the thermal head together with the carriage along the platen. By selectively heating the heat producing elements of the thermal head on the basis of printing information, a desired printing is obtained on the recording medium.

FIG. 13 shows a widely used conventional thermal transfer printer. A frame 1 has a flat plate-like platen 2 attached thereto with its printing surface set substantially perpendicular thereto. A carriage shaft 3 traverses the frame 1 in parallel to the platen 2 at the lower front of the platen 2. Further, a flange-like guide portion 4 is formed at the front end edge of the frame 1, and a carriage 5 is attached to the carriage shaft 3 and the guide portion 4 in a manner capable of reciprocating along the carriage shaft 3 and the guide portion 4.

Also, a thermal head 6 is attached to the front end portion of the carriage 5 in a manner facing the platen 2 and capable of moving into and out of contact with the platen 2 by means of a driver mechanism (not shown) (for example a cam mechanism provided on the carriage), and a ribbon cassette (see FIG. 14) to be described later is detachably mounted on the upper surface of the carriage 5, having an ink ribbon accommodated therein and guiding the ink ribbon to the position between the thermal head 6 and the platen 2. Further, provided respectively on the upper surface of the carriage 5 are a take-up bobbin 7 and a feed bobbin 8 for engaging reels of the ribbon cassette to take up the ink ribbon and to feed the ink ribbon.

Further a paper inserting opening 9 for feeding a sheet of paper (not shown) to the front of the platen 2 is formed at the back of the platen 2, and a paper feed roller 10 for transporting the sheet of paper at a constant speed is disposed at the portion of the paper inserting opening 9. A pressing roller 11 to be pressed by the paper feed roller 10 is rotatably disposed under the paper feed roller 10, and a paper feed motor 13 for rotating the paper feed roller 10 through a group of toothed wheels 12 is provided on one side surface of the frame 1. By thus driving the paper feed motor 13 drive and rotate the paper feed roller 10, a sheet of paper inserted from the paper inserting opening 9 is transported as it is clamped by the paper feed roller 10 and the pressing roller 11.

As has been described, in a conventional thermal transfer printer, a sheet of paper is inserted from the paper inserting opening 9 and the inserted paper is clamped between the paper feed roller 10 and the pressing roller 11. The paper feed roller 10 is rotated by driving the paper feed motor 13 to forward the sheet of paper in the direction perpendicular to traveling direction of the carriage 5. In the state where the thermal head 6 is pressed against the sheet of paper by a predetermined pressing force, the carriage 5 is caused to travel. At the same time, while taking up the ink ribbon of the ribbon cassette by rotating the take-up bobbin 7, the thermal head 6 is driven on the basis of a desired printing signal so as to selectively heat desired heat producing elements. Thereby a desired printing is performed on the sheet of paper by melting and transferring the ink on the ink ribbon.

A conventional ribbon cassette for use in such a thermal transfer printer will now be described by way of the drawings.

FIG. 14 is a top view showing the main portions of a conventional ribbon cassette in its printing state, i.e., in the state where the thermal head 6 is pressed against the platen 2; and FIG. 15 is a front view of a guide roller to be used in the ribbon cassette.

As shown in FIG. 14, a ribbon cassette body 22 has a pair of reels 23 rotatably supported thereon, disposed with a predetermined interval therebetween so as to engage the take-up bobbin 7 and the feed bobbin 8 of the thermal transfer printer as described and it also has five guide rollers 24A, 24B, 24C, 24D, 24E rotatably supported thereon in a manner facing the ribbon path thereof.

The pair of reels 23, 23 are each formed in a substantially cylindrical shape and the ink ribbon 25 is wound on the circumferential surface of the respective reels 23, 23 from their respective ends. When mounted on the carriage 5 of the above described thermal transfer printer, one of the pair of reels 23, 23 is engaged with the take-up bobbin 7 to serve as a take-up reel 23A for taking up the portion of the ink ribbon 25 which has been used for printing and the other is engaged with the feed bobbin 8 to serve as a feed reel 23B for feeding the ink ribbon 25. Further, on the respective inner peripheral surface of the reels 23A, 23B, a plurality of key grooves 26, 26 . . . are formed with intervals in the circumferential direction thereof, and they are engaged with the above described bobbins 7, 8 by means of these key grooves 26, 26 . . . In printing state, thus, the ink ribbon 25 is drawn from the feed reel 23B by means of traveling of the carriage 5 and the take-up reel 23A is driven to be rotated to take up the ink ribbon 25 in synchronization with the traveling of the carriage 5 so as to cause the ink ribbon 25 to run in the direction indicated by an arrow in the figure.

Further, as shown in FIG. 15, each of the above described guides 24 has flanges 24*b*, 24*c* formed on the two ends in the axial direction of a cylindrical body 24*a* thereof. The ink ribbon 25 is disposed between these 24*b*, 24*c* to eliminate quivering in the up and down direction of the ink ribbon 25 when it is run and to achieve a stable running.

Here, the guide roller 24B located to abut against the ink surface side of the ink ribbon 25 immediately after printing is positioned so that it may provide a peeling force by which the ink ribbon 25 may be peeled from the sheet of paper after printing.

Formed at symmetrical positions on the case body 22 of the ribbon cassette 21 at the side facing the above described platen 2 and the sheet of paper, are two concave portions 29A, 29B into which the thermal head 6 attached to the carriage 5 may be inserted and disposed, the thermal head 6 being inserted into the concave portion 29A on the left side as shown in the figure. It should be noted that the concave portion 29B on the right side as shown in the figure is provided so that the ribbon cassette 21 may be used upside down when the ink ribbon 25 on one surface has been used to the end, in the case of accommodating an ink ribbon which may be used for a plurality of times. Further, fixed guides 30, 30 each having a curved surface in the direction facing the platen 2 are provided on the two sides of each of the concave portions 29A, 29B.

Here, while various types of paper may be used as the recording sheet in printing, a different type of ink ribbon is to be used in printing, for example, between a sheet of plain paper which is an ordinary recording sheet and an OHP sheet consisting of a light transmitting plastic sheet for use in an overhead projector.

Specifically, among those used as the ink ribbon 25A for use in printing of a sheet of plain paper are: one constructed as shown in FIG. 16(A) in which an ink layer 36 mixing a dye such as of carbon and a resin is laminated on the surface of a base 35 of a resinous film such as polyethylene terephthalate and an overcoat 37 of a high viscosity material such as polyamide is laminated on the surface of the ink layer 36; and one constructed as shown in FIG. 16(B) in which a heat-soluble peeling layer 38 of a wax is placed between a base 35 and an ink layer 36.

In performing printing on a sheet of plain paper using such ink ribbon 25, after driving the above described thermal head 6 to melt/transfer the ink layer 36 of the ink ribbon 25 onto the sheet, an excellent print is obtained by performing hot peeling in which the ink ribbon 25 is peeled away from the sheet of plain paper in the state where the transferred ink layer 36 of the ink ribbon 25 is still at a high temperature and is in its half-molten state and when cohesive force in the ink layer 36 is small. For this reason, it is constructed to make shorter to the extent possible the distance between the printing portion by the thermal head 6 and the peeling portion of the ink ribbon 25.

On the other hand, one example of the ink ribbon 25 for use in printing on the above described OHP sheet is constructed as shown in FIG. 16(C) such that an ink layer 39 of a mixture of a dye such as carbon and a wax is laminated on the surface of a base 35 of a resinous film.

In printing on the OHP sheet using such ink ribbon 25, after driving the above described thermal head 6 to melt/transfer the ink layer 39 of the ink ribbon 25 onto the OHP sheet, cold peeling is performed in which the ink ribbon 25 is peeled away from the OHP sheet after the molten portion of the ink layer 39 is cooled to be solidified. This is because it is necessary to make smooth the surface of the ink layer to prevent irregular reflection of light at the surface of the ink layer transferred to the OHP sheet. For this reason, it is required to make longer the distance between the printing portion by the thermal head 6 and the peeling portion of the ink ribbon 25.

Since, as described, the position at which the ink ribbon 25 is to be peeled away from the recording sheet is different between printing onto a sheet of plain paper and printing onto an OHP sheet, a thermal transfer printer capable of performing printing on both a sheet of plain paper and an OHP sheet has conventionally been constructed as shown in FIG. 17 to have a peeling roller 40 for varying the peeling position of the ink ribbon 25.

Specifically, disposed on the upper surface of the carriage 5 at the downstream side of the thermal head 6 in the direction of running of the ink ribbon 25, is a peeling lever 41 which is operated to be turned between the position of the solid line and the position of the broken line as shown in the figure by a drive mechanism (not shown) of a solenoid or the like. Formed at the terminal end portion of the peeling lever 41 in a manner projecting upward therefrom, is a peeling roller 40 of which the surface to be moved into and out of contact with the ink ribbon 25 is covered for example with a sponge.

Here, the printing state onto the OHP sheet is defined by the case where the peeling lever 41 is operated to the position of the solid line as shown in the figure. The peeling roller 44 comes close to the platen 2 so as to be pressed by the ink ribbon 25. By delaying peeling of the ink ribbon 25 from the recording sheet, cold peeling is performed in which the ink ribbon 25 is peeled away from the recording sheet after the ink layer 39 of the ink ribbon 25 is cooled to be solidified. Further, the printing state onto a sheet of plain paper is defined by the case where the peeling lever 41 is operated to the position of the broken line as shown in the figure. By positioning the peeling roller 40 within the ribbon cassette 21 in a manner separated from the ink ribbon 25, the ink ribbon 25 is immediately stripped from the recording sheet as it is passed by the thermal head 6. Thereby hot peeling is performed in which the ink ribbon 25 is peeled away from the recording sheet while the ink layer 36 of the ink ribbon 25 is still in its molten state.

Further, in such thermal transfer printer, the shape of a cassette case is varied according to the type of the ink ribbon 25 and detection switch (not shown) disposed on the carriage is operated to be ON and OFF in accordance with the change in the shape to identify the type of the ink ribbon 25. Based on the detection result, then, for example, control is effected in the case of the ink ribbon for use in cold peeling so as to make longer the peeling distance of the ink ribbon by operating the peeling roller to perform cold peeling, or control is effected in the case of the ink ribbon for use in hot peeling so as not to operate the peeling roller to perform hot peeling with the peeling distance of the ink ribbon being relatively shorter as it is.

Furthermore, even in the ink ribbon for use in hot peeling, a number of types of ink ribbon are included, such as ink ribbons of monochrome or colored, a "one time" ribbon which may be used only once for printing or a "multi-time" ribbon which may be used in printing for a plurality of times, or a thin-type ink ribbon for accommodating a longer ink ribbon by thinning the thickness of the ink ribbon as a whole. It is necessary to provide suitable control according to each type, for example with respect to time of electrical conduction to the thermal head 6. Since it is required to discriminate each ink ribbon type from another, a large number of cassettes different in their shape are required to correspond to the respective ink ribbons if they are to be discriminated by shape. Thereby the number of the ribbon cassettes as component parts is increased, resulting in a problem that costs are increased.

Further, in the printing operation in hot peeling of the above described thermal transfer printer, not all the ink is transferred to the sheet by printing, and an ink layer 36*a* in its molten state remains as shown in FIG. 18 on the surface of the ink layer side of the ink ribbon 25 immediately after the printing, and this ink layer 36*a* possesses a tackiness. Thus, if feed amount of the ink ribbon after completing the printing equals to the traveling amount "A" of the carriage, the ink layer 36*a* in its molten state is stopped in the state where it abuts against the guide roller 24B, resulting in a problem that, when it is cooled as time elapses, the ink ribbon 25 and the guide roller 24B are stuck to each other. To prevent this, forwarding of the ink ribbon 25 until the ink ribbon 25 after printing completely passes the guide roller 24B ("B" in FIG. 19) may be considered. If so controlled, however, an extra amount of the ink ribbon 25 is to be forwarded, resulting in a problem that the wasteful consumption of the ink ribbon 25 is increased.

Further, in the conventional ribbon cassette as described, there has been a problem that, in the case of moving the carriage 5 in the "head-up" state where the thermal head 6 does not abut against the platen 2, for example when the sheet is transferred toward the side of the ink ribbon 25 at the time of line feed, the ink at the portion of the ink ribbon 25 supported by the fixed guides 30, 30 and the sheet abut against each other in a manner of rubbing, causing a tinting of the sheet where the ink adheres to the sheet as a stain.

Further, in the conventional thermal transfer printer as described, switching is made between hot peeling printing and cold peeling printing to control printing only by operating the peeling lever 41 to cause the peeling roller 40 to move toward and away from the platen 2. Not much problem is thus caused at the time of hot peeling printing. Since, however, in the case of performing cold peeling printing, the ink ribbon 25 is to be taken up by a winding force similar to that at the time of hot peeling printing, the peeling roller 40 may be moved away from the platen 2 due to the attaching play of the peeling lever 41 or due to the deformation of the sponge on the surface of the peeling roller 40. There has thus been a problem that a sufficient distance to the peeling of the ink ribbon which is required in cold peeling of ink ribbon cannot be secured where a suitable cold peeling printing cannot be performed. If taking up force of ink ribbon is set to a relatively weak level to solve this, a suitable cold peeling printing may be performed. In such a case, however, a problem occurs at the time of hot peeling printing that a suitable hot peeling printing cannot be performed because a sufficient peeling force of ink ribbon cannot be obtained or because timing for peeling is delayed.

Furthermore, in the above described thermal transfer printer, printing is performed while moving the carriage 5 in the state where the thermal head 6 is pressed against the sheet. The ink ribbon 25 is drawn from the side of the feed reel 23B with the traveling of the carriage 5 due to pressing of the thermal head 6 against the platen 2. At this time, however, problems occur such that the ink ribbon is moved diagonally where stable running cannot be obtained or that the ink ribbon 25 is consumed in a short time period, because the taking up amount of the ink ribbon 25 equals to the amount of traveling of the carriage 5.

SUMMARY OF THE INVENTION

In view of these points, it is an object of the present invention to provide a ribbon cassette by which the type of ink ribbon accommodated in the cassette may be identified without using a plurality of types of cassette case which are different in shape.

It is another object of the present invention to provide a ribbon cassette in which a plurality of detection holes corresponding to detection switches disposed on the upper surface of the carriage of the thermal transfer printer are formed on the surface of the cassette case at positions corresponding to the outside of the outermost periphery of the ink ribbon wound on each reel and detection holes at certain positions are covered according to the type of ink ribbon to be accommodated.

It is a further object of the present invention to provide a ribbon cassette which uses a simple structure capable of securely preventing a fault that the ink ribbon is struck to a guide roller for guiding the ink ribbon immediately after printing.

It is still another object of the present invention to provide a ribbon cassette which prevents a stain on the sheet between the sheet and the ink ribbon at the time of printing (especially when the carriage 5 is moved in its "head up" state for example at the time of line feed) and which can improve running stability of the ink ribbon.

It is yet another object of the present invention to provide a ribbon cassette in which: an ink ribbon is wound across a pair of rotatable reels; the middle portion of the ribbon path of the ink ribbon is brought out to the outside; a concave portion for inserting a thermal head is formed on a cassette case at said middle portion; and rotatably supported guide rollers are provided at the upstream and downstream side positions on said ribbon path in said concave portion.

It is a still further object of the present invention to provide a ribbon cassette in which: an ink ribbon is wound across a pair of rotatable reels; the middle portion of the ribbon path of the ink ribbon is brought out to the outside; a concave portion for inserting a thermal head is formed on a cassette case at said middle portion; and rotatably supported guide rollers are provided at the positions projecting farthest toward the platen at the upstream and downstream side positions on said ribbon path in said concave portion.

It is a yet further object of the present invention to provide a thermal transfer printer in which running stability of the ink ribbon may be improved by applying a suitable load to the ink ribbon being transported from the feed reel to the printing portion.

It is another object of the present invention to provide a thermal transfer printer in which, in addition to a feed reel and a take-up reel, a pair of rotatable pinch rollers serving as a second feed reel and a second take-up reel are disposed on the ribbon cassette and second feed bobbin and second take-up bobbin for engaging these pinch rollers are respectively disposed on the carriage of the thermal transfer printer, thereby taking up force of ink ribbon is applied by the second take-up bobbin and load is imparted by the second feed bobbin to the ink ribbon to be forwarded.

It is another object of the present invention to provide a thermal transfer printer in which both hot peeling printing and cold peeling printing are suitably performed by varying the taking up force of the ink ribbon.

It is another object of the present invention to provide a thermal transfer printer in which, in addition to a take-up reel, a rotatable pinch roller serving as a second take-up reel is disposed on the ribbon cassette and a second take-up bobbin engaging this pinch roller is disposed on the carriage of the thermal transfer printer, thereby taking up force of ink ribbon is imparted by the second take-up bobbin.

It is another object of the present invention to provide a thermal transfer printer in which, in addition to a take-up reel, a rotatable pinch roller serving as a second take-up reel is disposed on the ribbon cassette and a second take-up bobbin engaging this pinch roller is disposed on the carriage of the thermal transfer printer, thereby taking up force of ink ribbon is imparted by the second take-up bobbin where it is adapted so that the taken up amount by the second take-up bobbin is smaller than the taken up amount of the ink ribbon by the first take-up bobbin.

It is another object of the present invention to provide a thermal transfer printer in which the consumed amount of the ink ribbon may be reduced by making the taken up amount of the ink ribbon less than the traveling amount of the carriage.

It is another object of the present invention to provide a thermal transfer printer in which, in addition to a feed reel and a take-up reel, a pair of rotatable pinch rollers serving as a second feed reel and a second take-up reel are disposed on the ribbon cassette and second feed bobbin and second take-up bobbin for engaging these pinch rollers are respectively disposed on the carriage of the thermal transfer printer, thereby taking up force of ink ribbon is imparted by the second take-up bobbin and a load greater than the drawing force by the thermal head and the platen is applied by the second feed bobbin to the ink ribbon to be forwarded.

It is another object of the present invention to provide a thermal transfer printer in which, in addition to a feed reel and a take-up reel, a pair of rotatable pinch rollers serving as a second feed reel and a second take-up reel are disposed on the ribbon cassette and second feed bobbin and second take-up bobbin for engaging these pinch rollers are respectively disposed on the carriage of the thermal transfer printer, thereby taking up force of ink ribbon is imparted by the second take-up bobbin and a load is applied by the second feed bobbin to the ink ribbon to be forwarded and the fed amount of the ink ribbon by the second feed bobbin is set to be less than the traveling amount of the carriage.

According to a ribbon cassette of the present invention as described, a plurality of detection holes corresponding to detection switches disposed on the upper surface of the carriage of the thermal transfer printer are formed on the cassette case at positions corresponding to the outside of the outermost circumference of the ink ribbon. Those detection holes at certain positions are to be covered according to the type of ink ribbon to be accommodated. Based on the position of the covered holes, the ON/OFF state of the detection switches on the carriage is changed. Thereby the type of the ink ribbon accommodated in the ribbon cassette may be detected from the combination of ON/OFF of the detection switches and printing control according to the type of ink ribbon may be performed without changing the shape of the ribbon cassette.

Further, according to a ribbon cassette of the present invention as described, an ink ribbon is wound across a pair of rotatable reels. The middle portion of the ribbon path of the ink ribbon is brought to the outside. The cassette case has a concave portion formed at this middle portion for inserting the thermal head. Rotatably supported guide rollers are provided at positions projecting farthest toward the platen at upstream and downstream side positions on said ribbon path in said concave portion. It is thus possible to reduce the distance between the thermal head in its printing state and the guide roller. Accordingly, the amount of traveling of the carriage for slowing down after printing suffices to cause the ink portion in its molten state immediately after printing to pass the guide roller, whereby it is possible to prevent sticking of the ink to the guide roller.

Further, according to a ribbon cassette of the present invention as described, since a ribbon path regulated by guide rollers on the both sides thereof is formed in the vicinity of the thermal head, a stable running of the ink ribbon may be obtained. In addition, since the guide roller is rotatable, the sheet is caused to abut against the guide roller even if the sheet falls toward the ribbon cassette at the time of printing, whereby stain on the sheet may be prevented as the sheet is not rubbed due to the rotation of the guide roller.

Furthermore, according to a thermal transfer printer of the present invention as described, in addition to a feed reel and a take-up reel, a pair of rotatable ribbon rollers serving as a second feed reel and a second take-up reel are disposed on the ribbon cassette and a second feed bobbin and a second take-up bobbin engaging these ribbon rollers are respectively disposed on the carriage of the thermal transfer printer. A taking up force of the ink ribbon is imparted by the second take-up bobbin and a load is applied by the second feed bobbin to the ink ribbon to be forwarded. Thereby a suitable load may be applied to the ink ribbon being transported from the feed reel to the printing portion. Running stability of the ink ribbon may thus be improved, for example, even for an ink ribbon of the thin type.

Moreover, in a thermal transfer printer of the present invention as described, in addition to a feed reel and a take-up reel, a pair of rotatable ribbon rollers serving as a second feed reel and a second take-up reel are disposed on the ribbon cassette and a second feed bobbin and a second take-up bobbin engaging these ribbon rollers are respectively disposed on the carriage of the thermal transfer printer. A taking up force of the ink ribbon is imparted by the second take-up bobbin and a load is applied by the second feed bobbin to the ink ribbon to be forwarded. Thereby a suitable load may be applied to the ink ribbon being transported from the feed reel to the printing portion. Running stability of the ink ribbon may thus be improved.

Further, in a thermal transfer printer of the present invention as described, in addition to a take-up reel, a rotatable ribbon roller serving as a second take-up reel is disposed on the ribbon cassette and a second take-up bobbin engaging this ribbon roller is disposed on the carriage of the thermal transfer printer. A taking up force of the ink ribbon is imparted by the second take-up bobbin. Thus, by varying the taking up amount of the ink ribbon by the first take-up bobbin and the second take-up bobbin, taking up force of ink ribbon may be varied and both hot peeling printing and cold peeling printing may be suitably performed.

Furthermore, in a thermal transfer printer of the present invention as described, in addition to a feed reel and a take-up reel, a pair of rotatable ribbon rollers serving as a second feed reel and a second take-up reel are disposed on the ribbon cassette and a second feed bobbin and a second take-up bobbin engaging these ribbon rollers are respectively disposed on the carriage of the thermal transfer printer. A taking up force of the ink ribbon is imparted by the second take-up ribbon and a load greater than the drawing force by the thermal head and the platen is applied by the second feed bobbin to the ink ribbon to be forwarded. Alternatively, a taking up force of the ink ribbon is imparted by the second take-up bobbin and a load is applied by the second feed-bobbin to the ink ribbon to be forwarded and at the same time the feed amount of the ink ribbon by the second feed bobbin is set to be equal to or less than the traveling amount of said carriage. Thus the taken up amount of the ink ribbon is made to be less than the traveling amount of the carriage, whereby the consumption of the ink ribbon may be reduced.

BRIEF DESCRIPTION OF THE DRAWINGS

FIGS. 16(A), 16(B) and 16(C) show sections of the construction of ink ribbons, wherein: FIGS. 16(A), (B) are sections respectively of ink ribbons for hot peeling; and FIG. 16(C) shows a section showing an ink ribbon for cold peeling.

DETAILED DESCRIPTION OF THE PREFERRED EMBODIMENTS

Figure 1:
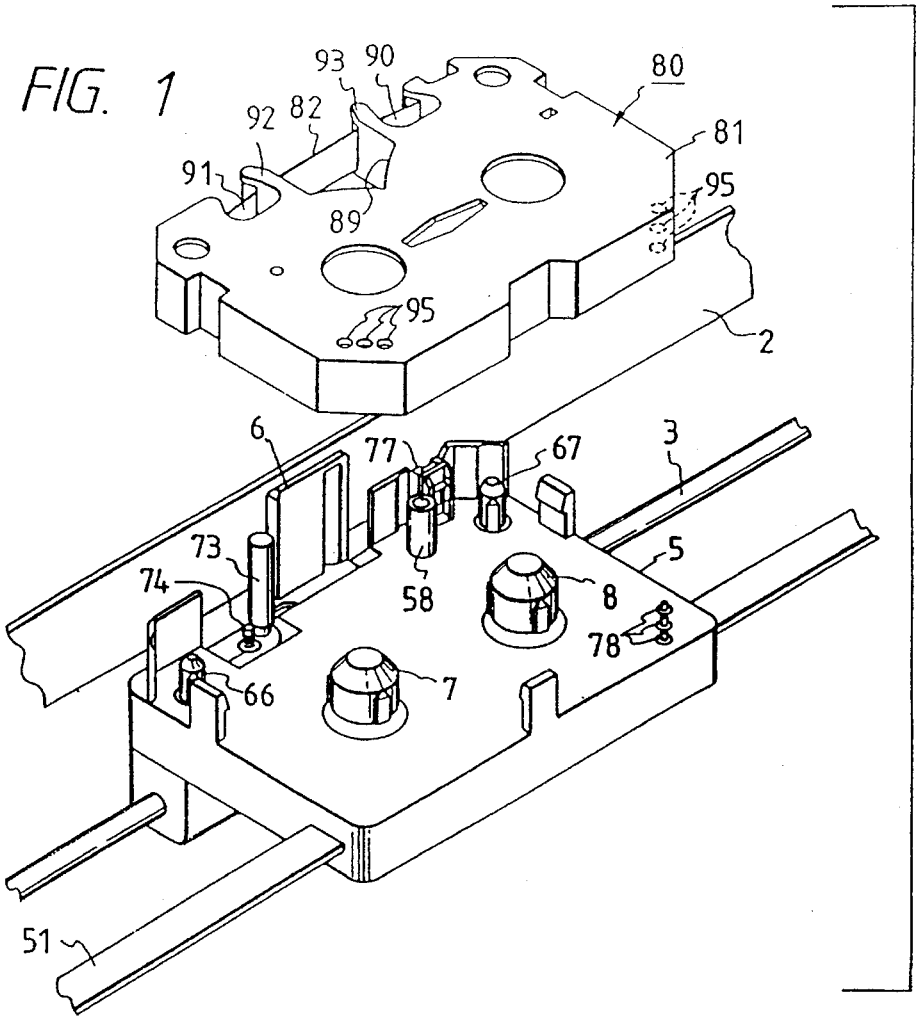
FIG. 1 is a perspective view of certain portions showing a first embodiment of a thermal transfer printer and a ribbon cassette of the present invention.

Some embodiments of the present invention will now be described with reference to FIGS. 1 to 10.

FIGS. 1 to 7 show an embodiment of a thermal transfer printer of the present invention. A motor 52 for head up/down to drive a mechanism for moving a thermal head 6 into pressed-contact with and away from a platen 2 is disposed on a carriage 5 which is adapted to be capable of reciprocating along the platen 2 through a drive belt 51 by means of drive by a carriage driving motor (not shown). A transmission gear 54 is meshed with an output pinion gear 53 of the head up/down motor 52. Meshed with this transmission gear 54 is a gear portion 56 formed on the outer periphery of a cam 55, and a cam groove 57 for contacting/withdrawing operation of the head is formed on the upper surface of the cam 55.

Further, a support shaft 58 is disposed on the carriage 5 toward the platen 2, and, in the present embodiment, the support shaft 58 is formed as shown in FIG. 1 in a manner projecting from the upper surface of the carriage 5 so that positioning may be stably made on the carriage 5. A substantially T-shaped head lever 59 is attached to the support shaft 58 in a manner capable of oscillating about the support shaft 58, and a head mounting base 60 facing the platen 2 is fixed by means of screw at the portion of the head lever 59 toward the platen 2. The thermal head 6 is mounted on the head mounting base 60 at a surface facing the platen 2 and a stopper 61 is caused project therefrom so as to have a predetermined distance with respect to the reverse surface of the head mounting base 60.

A substantially L-shaped head pressing lever 62 is attached to the support shaft 58 in a manner capable of oscillating about the support shaft 58, and a pin 62*a* for engaging the cam groove 57 of the cam 55 is formed on one end portion of the head pressing lever 62. On the other end portion 62*b* of the head pressing lever 62 is disposed between the reverse surface of the head mounting base 60 of said head lever 59 and the stopper 61, and a spring retaining portion is raised on the other end portion 62*b*. Further, a strong pressing spring 63 is placed between the spring retaining portion and the head mounting base 60. By the urging force of the strong pressing spring 63, the head pressing lever 62 is retained in the state where it is caused to abut against the stopper 61 of the head lever In this state, the head pressing lever 62 and the head lever 59 are integrally turned by the rotation of the cam 55 at the time when the head is moved up and down. Further, a spring support pin 64 is caused to protect from the carriage 5. A weak pressing spring 64*a* of which the spring force is smaller than that of the strong pressing spring 63 is extended between the spring support pin 64 and the head lever 59 so as to impart an urging force by which the head lever 59 continually presses the thermal head 6 against the platen 2.

Figure 2:
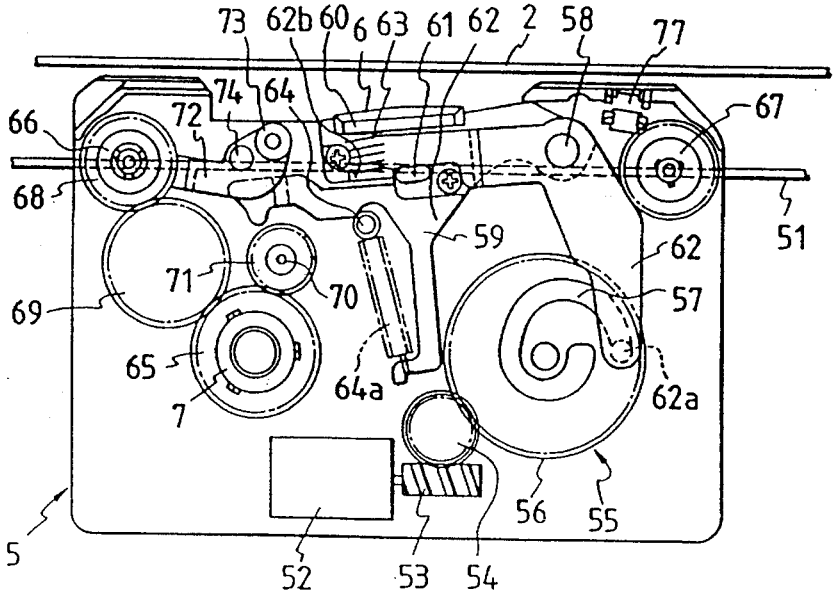
FIG. 2 is a view explanatory of the construction of a carriage in an embodiment of a thermal transfer printer of the present invention, showing its non-printing state.
Figure 3:
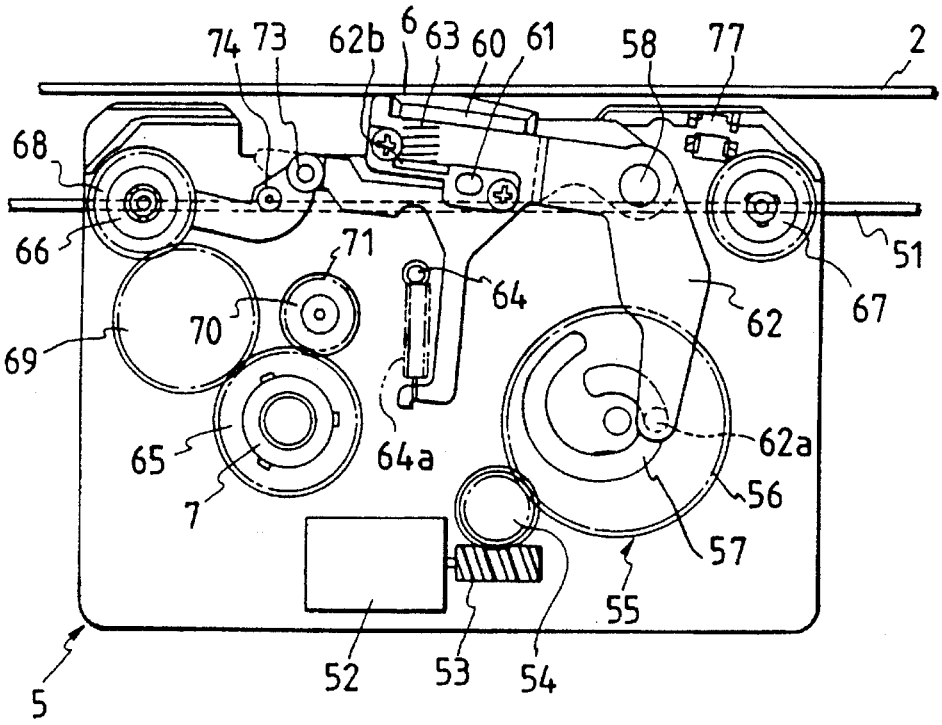
FIG. 3 shows printing state onto a sheet of plain paper in an embodiment of a thermal transfer printer of the present invention.
Figure 4:
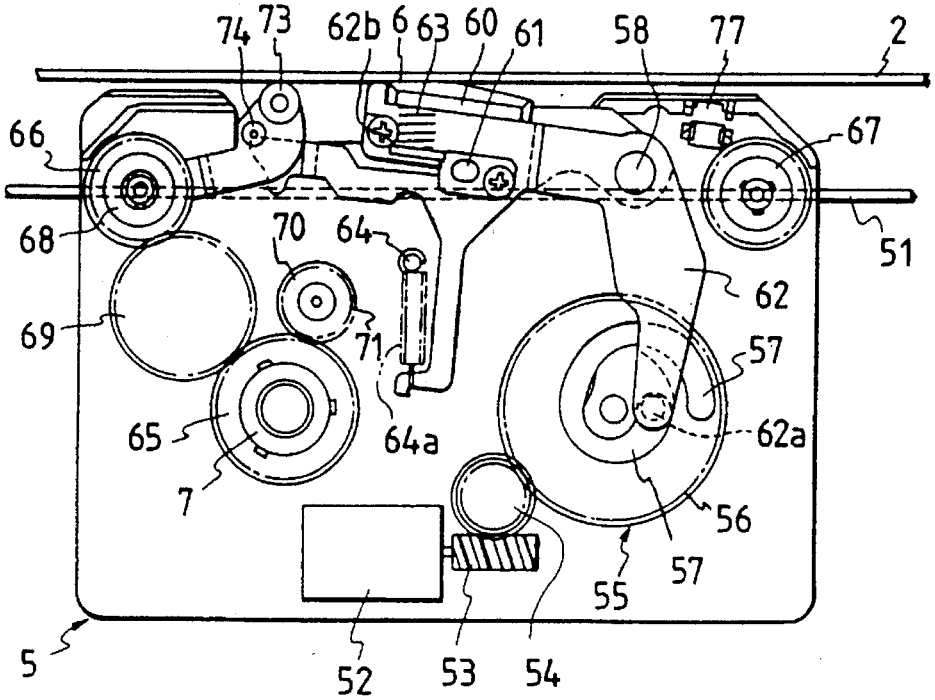
FIG. 4 shows printing state onto an OHP sheet in an embodiment of a thermal transfer printer of the present invention.

Further, as shown in FIG. 1, a take-up bobbin 7 and a feed bobbin 8 of the ink ribbon serving as a first take-up mechanism are disposed respectively on the carriage 5, and, as shown in FIGS. 2 to 4 a taking-up gear 65 is attached coaxially to the lower portion of the taking-up bobbin 7 through a fiction mechanism (not shown). Further, in the present embodiment, a second take-up bobbin 66 and a second feed bobbin 67 serving as a second take-up mechanism are disposed respectively on the carriage 5. A second take-up gear 68 is coaxially attached to the lower portion of the second take-up bobbin 66 through a friction mechanism (not shown) and a friction mechanism (not shown) using the pressing force of a spring for imparting a predetermined load to the second feed bobbin 67 is attached coaxially to the lower portion of the second feed bobbin 67. It should be noted that the load due to this friction mechanism may be suitably selected by varying the pressing force of the spring.

Further, a transmission gear 69 meshed respectively with the take-up gear 65 and the second take-up gear 68 is disposed on the carriage 5, and an output gear 71 of a take-up motor 70 is meshed with the take up gear 65. Here, the take-up bobbin 7 and the second take-up bobbin 66 are rotated by drive of the take-up motor 70 respectively through the output gear 71 and the transmission gear 69. Further, gear ratios and diameters of the take-up gear 65 and the second take-up gear 68 with respect to the transmission gear 69 are set so that the taking up amount of the ink ribbon by the take-up bobbin 7 is greater than the taking up amount of the ink ribbon by the second take-up bobbin 66.

Further, a peeling lever 72 urged in the direction away from the platen 2 by a spring 75 (see FIG. 5) is rotatably attached to the rotation shaft 66*a* of the second take-up bobbin 66, and a peeling roller 73 having such as a sponge covering the surface thereof is raised from the terminal end of the peeling lever 72 so as to be extended from the upper surface of the carriage 5. Further, an engaging pin 74 is attached in a manner movable in an up and down direction to the vicinity of the peeling roller 73 of the peeling lever 72, and a spring 76 for urging the engaging pin 74 upward is disposed around the outer periphery of the engaging pin at the upper surface side of the peeling lever 72. The engaging pin 74 is retained by the urging force of the spring 76 such that the lower end portion thereof does not project downward of the peeling lever 72. By pressing the engaging pin 74 downward against the urging force of the spring 76 to cause the lower end portion thereof to project downward from the peeling lever 72, the engaging pin 74 is engaged with the terminal end portion of the head lever 59.

Figure 5:
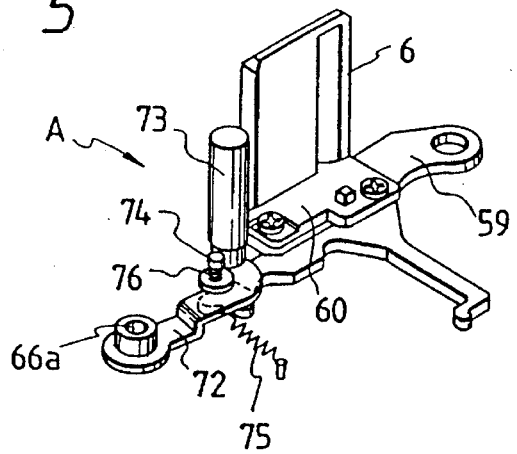
FIG. 5 is a perspective view showing the portions of a peeling lever and a head lever in an embodiment of a thermal transfer printer of the present invention.
Figure 6A:
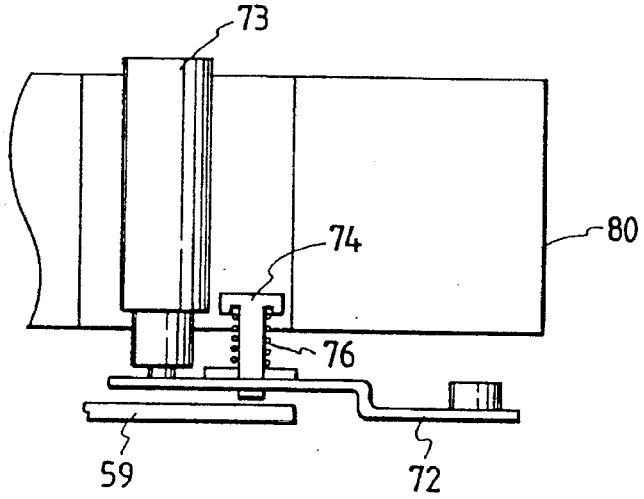
FIG. 6A and 6(B) shows engaged and disengaged states of the peeling lever and the head lever in an embodiment of a thermal transfer printer of the present invention.
Figure 6B:
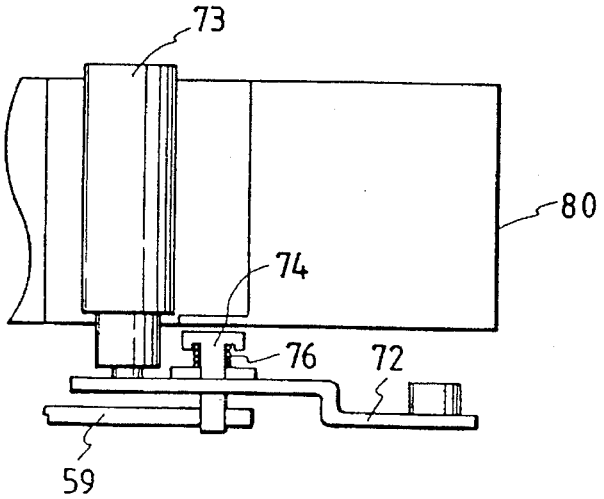

FIGS. 5 and 6 show in further detail the construction of the peeling lever 72. FIG. 5 is perspective view showing the portion of the peeling lever 72 and the head lever 59, and FIG. 6 consists of partial side views each as seen from the direction of the arrow A of FIG. 5. Here, FIG. 6(A) shows the state where the engaging pin 74 does not project downward so that the peeling lever 72 and the head lever 59 do not engage each other, while FIG. 6(B) shows the state where the engaging pin 74 is caused to project downward whereby the peeling lever 72 engages the head lever 59 so that the peeling lever 72 is turned toward the platen 2 together with the head lever 59.

Further, disposed on the upper surface of the carriage 5 is a photo sensor 77 which is to detect the finishing end of the ink ribbon to be used and to detect a color marker representing the respective color of a color ink ribbon.

Furthermore, provided on the upper surface of the carriage 5 are a plurality of detection switches 78 FIG. 1 for performing ON/OFF operation in accordance with detection holes formed on a ribbon cassette when the ribbon cassette to be described later is mounted thereon.

In the thermal transfer printer as described, a ribbon cassette accommodating an ink ribbon is detachably mounted on the upper surface of the carriage 5. An embodiment of the ribbon cassette of the present invention mounted in this manner will now be described with reference to FIGS. 7 and 8.

Figure 7:
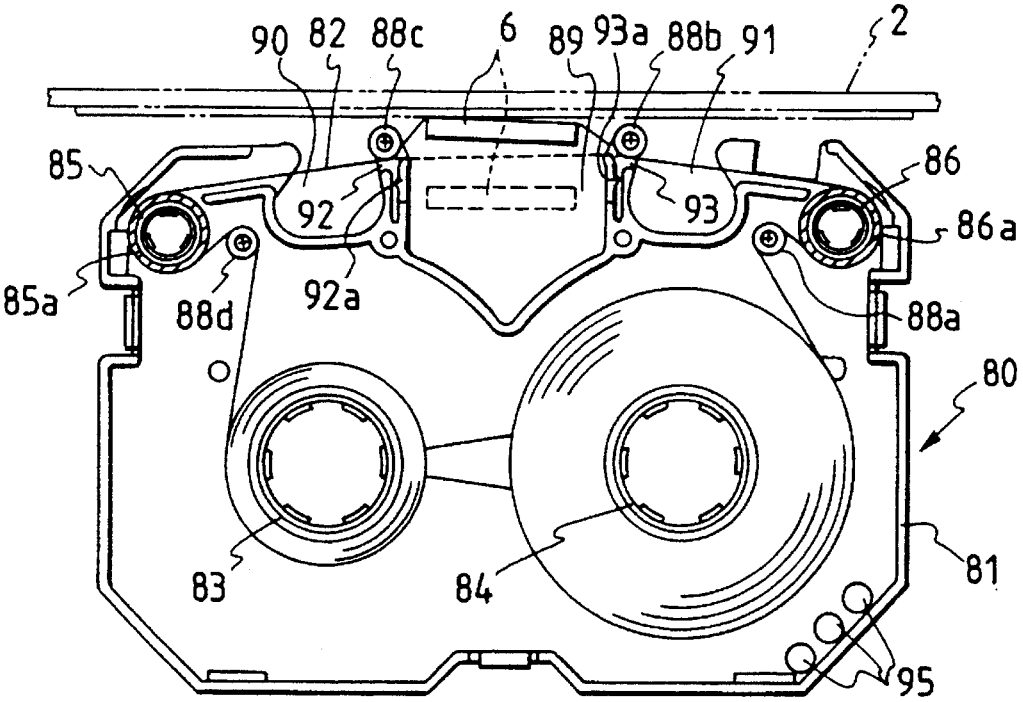
FIG. 7 shows certain portions of a ribbon cassette being a first embodiment of the ribbon cassette of the present invention.
Figure 8:
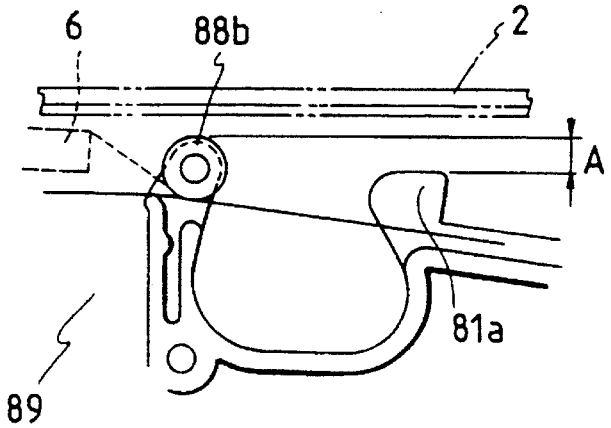
FIG. 8 is an enlarged view of certain portions of a guide roller of an embodiment of the ink ribbon cassette of the present invention.

FIG. 7 is a top view of certain portions showing an embodiment of a ribbon cassette 80 of the present invention, and FIG. 8 is an enlarged view for showing the main portion in the vicinity of a concave portion into which the thermal head is inserted. As shown in the figures, disposed within a body case 81 are: a pair of reels 83, 84 supported rotatably thereon; a pair of ribbon rollers 85, 86 supported rotatably thereon and arranged at positions where they abut against the back surface of an ink ribbon 82 to which an ink is not applied; and a plurality, or four in the present embodiment, of guide rollers 88*a*, 88*b*, 88*c*, 88*d* supported rotatably thereon and facing the ribbon path.

The pair of reels 83, 84 are each formed into a substantially cylindrical shape, and a predetermined ink ribbon 82 is wound on the peripheral surface of each of the reels 83, 84 from their respective ends. When the ribbon cassette 80 is mounted on the carriage 5, one of the pair of reels 83, 84 becomes a take-up reel 83 for taking up the portion of the ink ribbon 82 which has been used for printing and the other engages the feed bobbin 8 to become a feed reel 84 for forwarding the ink ribbon.

The pair of ribbon rollers 85, 86 are each formed into a substantially cylindrical shape, and firmly attached on the outer periphery thereof by means of monolithic forming, fitting or the like are covering members 85*a*, 86*a* formed of a material having a relatively higher coefficient of friction with respect to the ink ribbon which is for example made of a rubber. When the ribbon cassette 80 is mounted on the carriage 5, one of them engages the take-up bobbin 66 on the carriage 5 so as to be a ribbon take-up roller 85 for taking up the ink ribbon 82 which has been used for printing, and the other engages the feed bobbin 67 so as to be a ribbon feed roller 86 for forwarding the ink ribbon 82.

Further, a concave portion 89 for inserting the thermal head 6 is formed on the ribbon cassette 80 at the center portion on the side toward the platen 2. The ink ribbon 82 is once brought to the outside of the cassette case 81 at this concave portion 89. Here, notch portions 91, 90 into which the support shaft 58 and the peeling roller 73 are respectively inserted are formed at the symmetrical positions on the two sides of the concave portion 89.

Here the ribbon path of the ink ribbon 82 is such that it is drawn from the feed reel 84 through the guide roller 88*a* around the outer periphery of the covering member 86*a* of the ribbon feed roller 86 for feeding and then is guided to the portion of the thermal head 6 through the guide roller 88*b* which is arranged at the position projecting from the case body 81 farthest toward the platen 2 and which is positioned on the right side as shown in the figure of the concave portion 89. Furthermore, it is to be taken up by the take-up reel 83 by way of the guide roller 88*d*, through the guide roller 88*c* which is arranged at the position projecting farthest toward the platen 2 in a similar manner as the guide roller 88*b* and which is positioned on the left side as shown in the figure of the concave portion 89 and around the outer periphery of the covering member 85*a* of the ribbon take-up roller 85.

Also, the guide rollers 88*b*, 88*c* positioned at the two sides of the concave portion 89 are rotatably supported on the terminal end portions of arms 92, 93 which are extended at the two sides of the concave portion 89 of the case body 81. Further, guide ribs 92*a*, 93*a* are provided at suitable positions on the arms 92, 93, where the ribbon path at the time of "head up" of the thermal head 6 is formed by the guide ribs 92*a*, 93*a*.

Further, the wrapping angles of the ink ribbon 82 with respect to the ribbon feed roller 86 and the ribbon take-up roller 85 are set to such angles that a friction force may be obtained by which feeding of the ribbon or taking up of the ribbon is possible by means of the respective rotation of the ribbon feed roller 86 or the ribbon take-up roller 85. And such wrapping angle is constant at all times without a change between at the winding start and the winding end of the ink ribbon due to the guide rollers 88*a*, 88*b*, 88*c*, 88*d*. Thereby taking up force and load at the time of feeding of the ink ribbon are respectively constant at all times and are not varied between the winding start portion and the winding end portion of the ink ribbon and a stable running of the ribbon may thus be performed.

The portion of the ribbon path constructed by the ribbon feed roller 86, the guide roller 88*b* positioned on the right side as shown in the figure of the concave portion 89, the guide roller 88*c* positioned on the left side as shown in the figure of the concave portion 89 and the ribbon take-up roller 85 is formed into substantially a straight line and is adapted so that the ink ribbon 82 passes the portions of the guide rollers 88*b*, 88*c* which are most distant from the platen 2.

Further, as shown in FIG. 8, the terminal end position facing the platen 2 of the guide roller 88*b* positioned on the right side as shown in the figure of the concave portion 89 is caused to project by a predetermined dimension "A" toward the platen 2 from a terminal end position 81*a* facing the the platen 2 of the case body 81. This is also true for the guide roller 88*c* positioned on the left side as shown in the figure of the concave portion 89. In other words, the two guide rollers 88*b*, 88*c* are disposed at the foremost position thereof with respect to the platen 2. Here, the predetermined dimension "A" to be projected is preferably ½ or more of the outer dimension of the guide rollers 88*b*, 88*c*. By constructing in this manner, since the guide rollers 88*b*, 88*c* are rotated, a stain on the sheet may be substantially reduced even if the sheet is caused abut against the guide rollers 88*b*, 88*c* as a result of the sheet's falling toward the ink ribbon 82. Furthermore, since the traveling amount for slowing down of the carriage 5 after printing suffices to cause the ink portion in its molten state immediately after the printing to pass the guide roller 88*c*, sticking of the ink to the guide roller 88*c* may be prevented.

Figure 11:
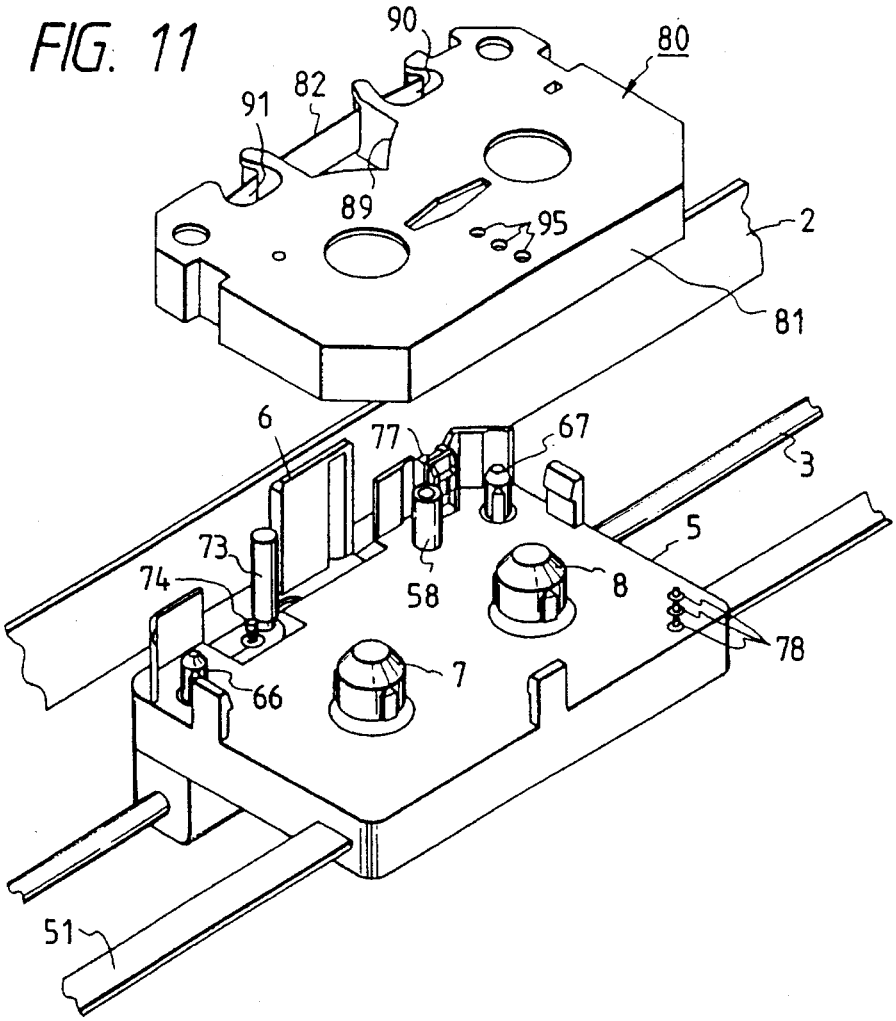
FIG. 11 is a perspective view showing certain portions of a second embodiment of the thermal transfer printer and the ribbon cassette of the present invention.

Further, on a corner portion of this ribbon cassette 80 at the outside of the outermost circumference of the ink ribbon 82 wound on the feed reel 84, three detection holes 95 are formed obliquely to the end surface of the cassette case 81 so as to correspond to the detection switches 78 of the carriage 5. By forming the detection holes 95 obliquely in this manner, a large forming space may be secured. Further, since the detection holes 95 are formed at the position outside the outermost periphery of the ink ribbon wound on the feed reel 84, the detection switches 78 do not contact the ink ribbon 82 and do not become an obstruction. Thus, when certain detection holes 95 of these detection holes 95 are covered with a seal or the like in accordance with the type of an ink ribbon to be accommodated, the covered detection holes 95 operate to press the detection switches 78 mounted on the carriage 5, whereby the type of the ink ribbon may be identified for example as to: whether it is a monochrome ribbon or a color ink ribbon; whether it is a "one-time" ribbon which may be used only once for printing or a "multi-time" ribbon which may be used for a plurality of times in printing; and whether or not it is an ink ribbon of the thin type in which an ink ribbon having a longer distance is accommodated by thinning the thickness of the ink ribbon as a whole. A suitable printing control is to be performed at the thermal transfer printer according to the type of thus identified ink ribbon. It should be noted that a similar advantage may also be obtained by forming the respective position of the detection holes to be formed at specific positions according to the type of ink ribbon to be accommodated, and, in such a case, there is no need to cover the detection holes 95 with a seal or the like. Furthermore, while in the above described embodiment the detection holes 95 have been formed obliquely on the cassette case 81, they are characterized in that they are formed so as to correspond to the detection switches 78 mounted on the carriage 5 as shown in FIG. 11. If the detection switches 78 are mounted on the carriage 5 formed not obliquely but formed at positions substantially corresponding to the perpendicular bisector of an imaginary line segment connecting the center lines of the take-up bobbin 7 and the feed bobbin 8, the detection holes 95 on the ribbon cassette 80 may also be formed not obliquely but correspondingly to such detection switches 78. In this case, it is also necessary to form the detection switches 78 and the detection holes 95 so that they are outside of the outermost circumference of the wound ink ribbon 82.

Figure 9:
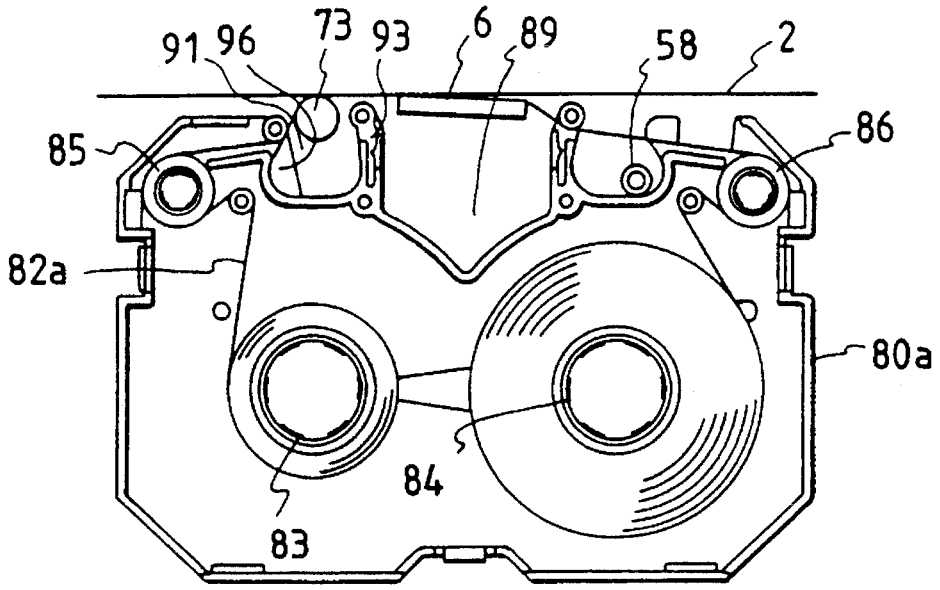
FIG. 9 shows the construction of certain portions of a ribbon cassette accommodating an ink ribbon for cold peeling in the ink ribbon cassette of the present invention.
Figure 10:
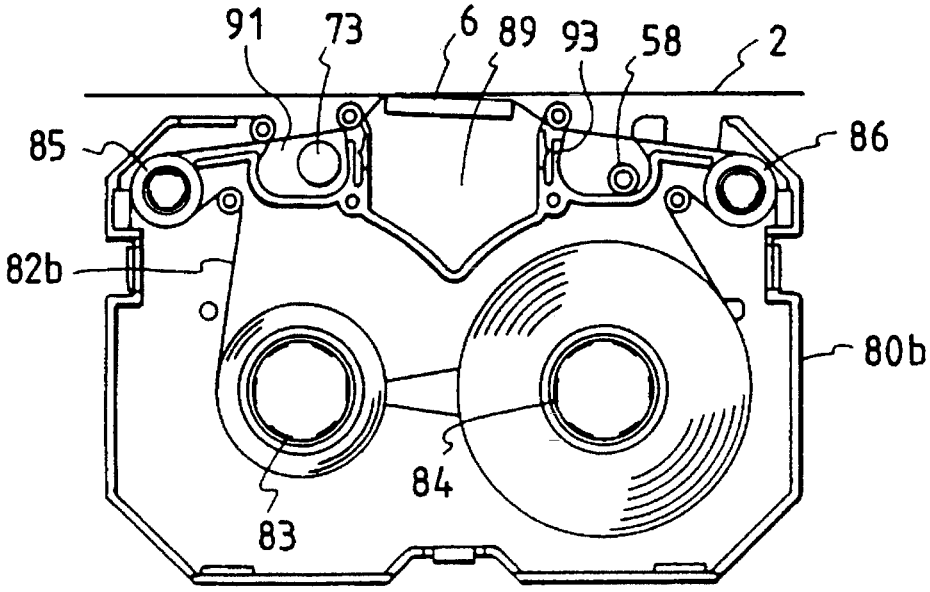
FIG. 10 is the construction of certain portions of a ribbon cassette accommodating an ink ribbon for hot peeling in the ink ribbon cassette of the present invention.

Further, of the ribbon cassettes 80 to be used in the thermal transfer printer of the present invention, there are: a ribbon cassette 80*a* as shown in FIG. 9 which accommodates an ink ribbon 82*a* for use in cold peeling; and a ribbon cassette 80*b* as shown in FIG. 10 for use in hot peeling. The ribbon cassette 80*a* accommodating the ink ribbon 82*a* for use in cold peeling has a pressing portion 96 for pressing downward the engaging pin 74 of the carriage 5 formed at a portion of the notch portion 91 thereof into which the peeling roller 73 is inserted when it is mounted on the carriage 5. For this reason, when the ribbon cassette 80*a* for use in cold peeling is mounted on the carriage 5, the engaging pin 74 is pressed to be lowered as shown in FIG. 6(B) by the pressing portion 96, thereby the lower end portion of the engaging pin 74 engages the head lever 59 where the peeling lever 72 becomes rotatable with the rotation of the head lever 59. Further, since no pressing portion as that of the ribbon cassette 80*a* for use in cold peeling is formed on the notch portion 91 of the ribbon cassette 80*b* which accommodates the ink ribbon 82*b* for use in hot peeling, the engaging pin 74 is not pressed to be lowered as shown in FIG. 6(A) even when the ribbon cassette 80*b* is mounted on the carriage 5. Since the engaging pin 74 and the head lever 59 are not engaged with each other, the peeling lever 72 is not turned even if the head lever 59 is oscillated to press the thermal head 6 against the platen 2.

A description will now be given with respect to the operation of the thermal transfer printer and the ink ribbon within the ribbon cassette of the above described embodiment.

First, as shown in FIG. 2, in the state where the cam 55 is rotated farthest to the left as shown in the figure, the head pressing lever 62 is oscillated farthest to the left about the support shaft 58 as shown in the figure, since the pin 62*a* of the head pressing lever 62 is positioned at the outermost circumference of the cam groove 57. Since the head pressing lever 62 is caused to abut against the stopper 61 of the head lever 59 by the urging force of the strong pressing spring 63 so that the head mounting base 60 is operated together with the head pressing lever 62, the thermal head 6 is maintained in its "head-up" state where it is placed away from the platen 2 due to this oscillated position of the head pressing lever 62.

In this cam position, while printing is not performed, traveling of the carriage 5 in non-printing state or removing of slack of the ink ribbon by driving the ribbon take-up motor 70 or color sensing operation by the photo sensor in the case of using a color ink ribbon is performed.

Next, in the case where a regular printing onto a sheet of plain paper or the like is to be performed by mounting on the carriage 5 the ribbon cassette 80*b* as shown in FIG. 10 accommodating the ink ribbon for use in hot peeling, the cam 55 is rotated to the right as shown in FIG. 3 from the state as shown in FIG. 2 by driving the head up/down motor 52, whereby the pin 62*a* of the head pressing lever 62 is positioned to the position closest to the rotating center of the cam groove 57 so that the head pressing lever 62 is oscillated farthest to the right as shown in the figure about the support shaft 58. Thereby the head pressing lever 62 is separated from the stopper 61 of the head mounting base 60, where the head mounting base 60 is pressed against by the spring retaining portion of the head pressing lever 62 through the strong pressing spring 63. Since in this state the urging force of the weak pressing spring 64*a* is imparted to the head lever 59, a pressing force totaling the urging forces of the strong pressing spring 63 and the weak pressing spring 64*a* is imparted to the head mounting base 60 so that the thermal head 6 is pressed against the platen 2 with a strong pressing force.

In this state, while moving the carriage 5 along the platen 2 and driving the take-up motor 70 to take up the ink ribbon 82, the thermal head 6 is driven to perform a desired printing on a sheet of plain paper. At this time, for the ink ribbon 82, rotation control of the ribbon take-up motor 70 is effected such that the amount of the ink ribbon to be taken up by the second take-up bobbin 66 is for example 105~110% with respect to the traveling amount of the carriage 5. Thereby the ink ribbon may be taken up with continually receiving a tension and it is possible to peel the ink ribbon after printing away from the sheet with a sufficient peeling force.

Further, in the case where, unlike regular printing, the ribbon cassette 80*a* as shown in FIG. 9 accommodating the ink ribbon for use in cold peeling is mounted on the carriage 5 to perform printing on an OHP sheet, the pin 62*a* of the head pressing motor 62 is positioned to the innermost circular portion of the cam groove 57 by rotating the head up/down motor 52 further to the left from the state as shown in FIG. 4. Since the dimension of the width of the cam groove 57 at this position is formed relatively larger, a gap is formed between the pin 62*a* of the head pressing lever 62 and the cam groove 57. Since the head pressing lever 62 is thereby rotated to abut against the stopper 61 by the urging force of the strong pressing spring 63, the thermal head 6 is to be pressed against the platen 2 only by the urging force of the weak pressing spring 64*a*. Printing may thus be performed with a pressing force which is relatively weak comparing to the case of regular printing onto a sheet of plain paper or the like. Further, as shown in FIG. 6(B), since the engaging pin 74 on the carriage 5 is pressed to be lowered by the pressing portion 96 formed on the ribbon cassette 80*a* so as to cause the engaging pin 74 to engage the head lever 59, the peeling lever 72 is turned simultaneously with the pressing operation of the thermal head 6 against the platen 2 due to oscillation of the head lever 59. The peeling roller 73 is pressed by the platen 2 where a longer peeling distance of the ink ribbon 82*a* from the printing position may be formed.

In this state, while moving the carriage 5 along the platen 2 and driving the take-up motor 70 to take up the ink ribbon, the thermal head 6 is driven on the basis of desired printing signal to perform desired printing on the OHP sheet. At this time, rotation control of the ribbon take-up motor 70 is effected such that the amount of the ink ribbon to be taken up by the second take-up bobbin 66 is smaller than (for example about 90~95% of) the traveling amount of the carriage 5. As a result, little tension is applied to the ink ribbon from the printing position to the peeling position. The peeling roller 73 is not caused to move away from the platen 2 as it is not affected by play at the peeling lever 72 or deformation of the sponge. Thus a relatively longer peeling distance of the ink ribbon from the printing position may be securely formed. Further, since taking up amount of the ink ribbon by the take-up bobbin 7 is set to be greater than taking up amount of by the second take-up bobbin 66, taking up is effected with a suitable tension for the ink ribbon after peeling. Stable taking up of the ink ribbon may thus be performed.

In controlling drive frequency of the above described take up motor 70, the position of the detection holes 95 of the ribbon cassette 80 is detected by the detection switches 78 in a manner as described, so as to identify whether it is the ribbon cassette 80*a* for use in cold peeling or the ribbon cassette 80*b* for use in hot peeling to automatically effect switching control in accordance with such identified result.

As has been described, in the thermal transfer printer according to the present embodiment, the second take up bobbin 66 with taking up amount of ink ribbon relatively less than that of the take up bobbin 7 is provided and taking up amount of the ink ribbon by the second take up bobbin 66 is varied with respect to traveling amount of the carriage 5 by controlling drive frequency of the take up motor 70. Thus, in the case of performing cold peeling printing, separation of the peeling roller 74 from the platen 2 may be prevented to perform suitable printing. Further, in the case of performing hot peeling printing, since the ink ribbon may be peeled by a suitable peeling force, an excellent hot peeling printing may be performed.

Further, since a suitable load is given to the ink ribbon 82 forwarded by the second feed bobbin 67, a suitable tension is continually applied to the ink ribbon 82 to make stable the running thereof. For example, even for the type of thin ink ribbon of which stable running of the ribbon is difficult to be obtained, an excellent running of ribbon may be achieved.

Figure 12:
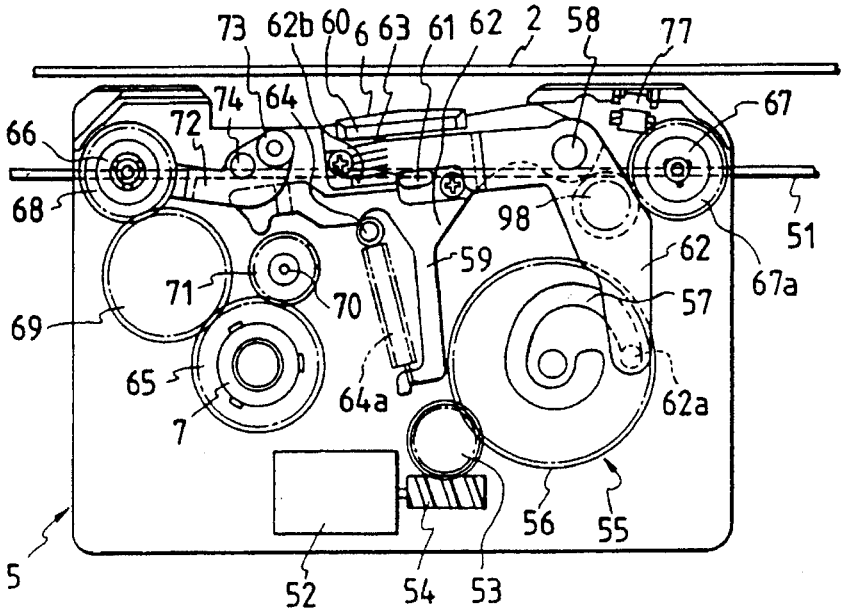
FIG. 12 shows the construction of a carriage in a third embodiment of the thermal transfer printer of the present invention.
Figure 13:
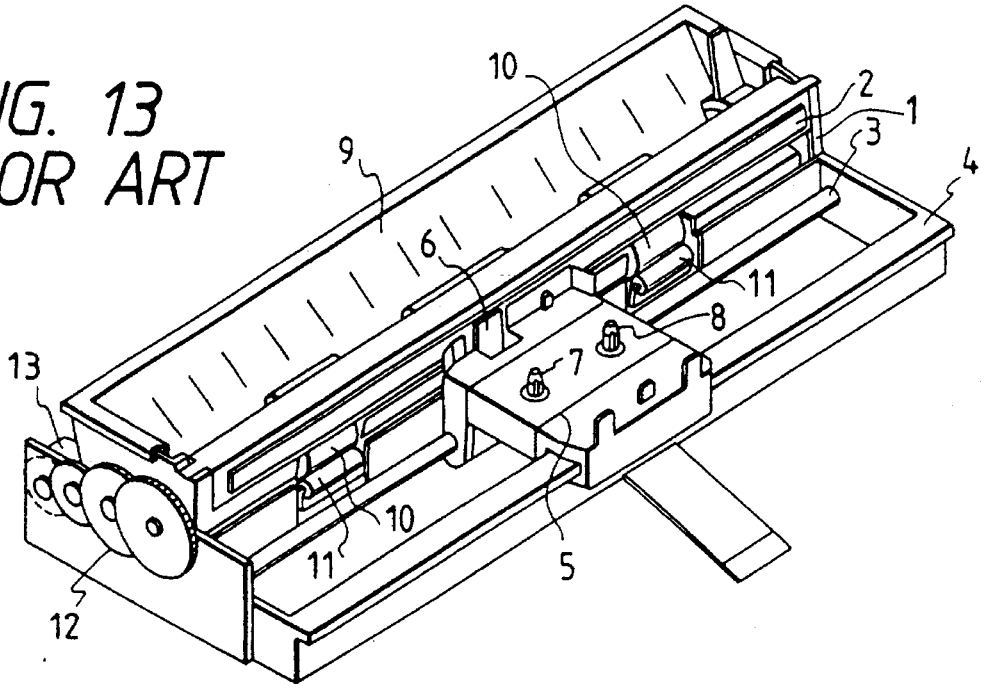
FIG. 13 PRIOR ART
FIG. 13 is a perspective view showing a generally used conventional thermal transfer printer.
Figure 14:
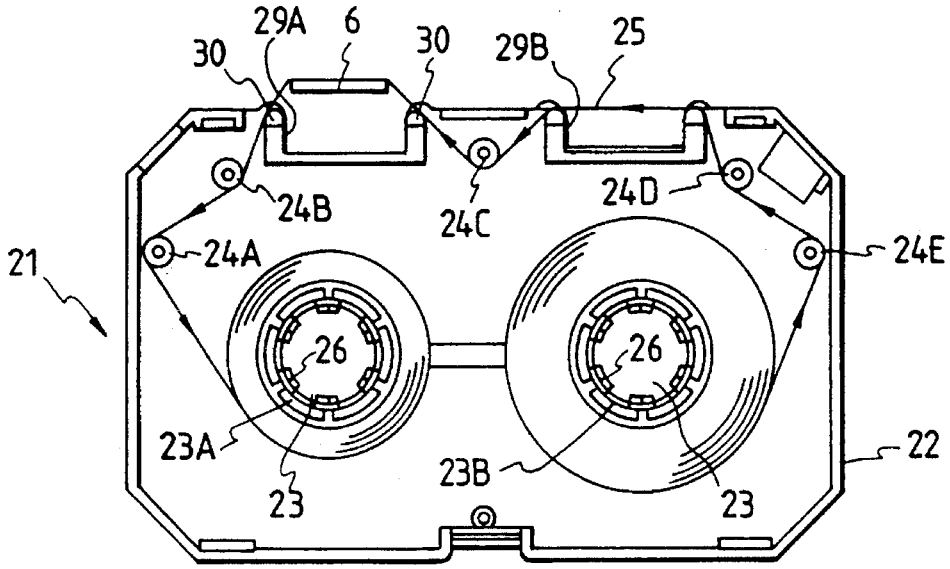
FIG. 14 PRIOR ART
FIG. 14 shows certain portions of a conventional ribbon cassette.
Figure 15:
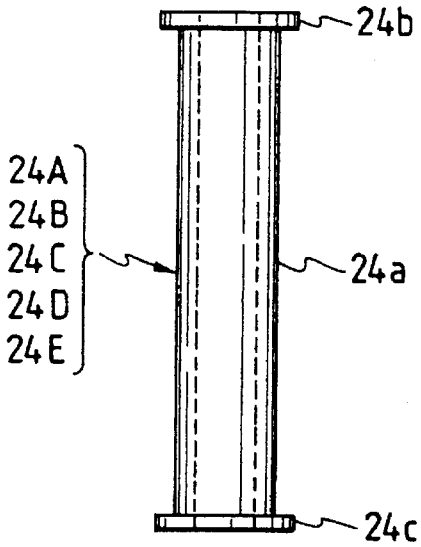
FIG. 15 is a front view for explaining the construction of a guide roller used in a ribbon cassette.
Figure 16A:
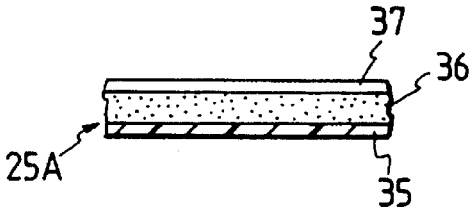
Figure 16B:
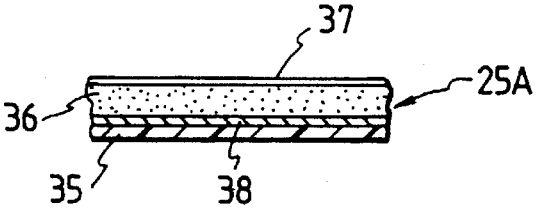
Figure 16C:
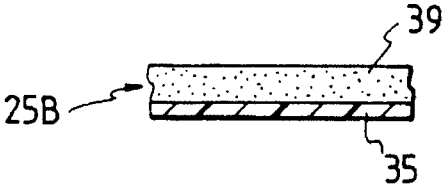
Figure 17:
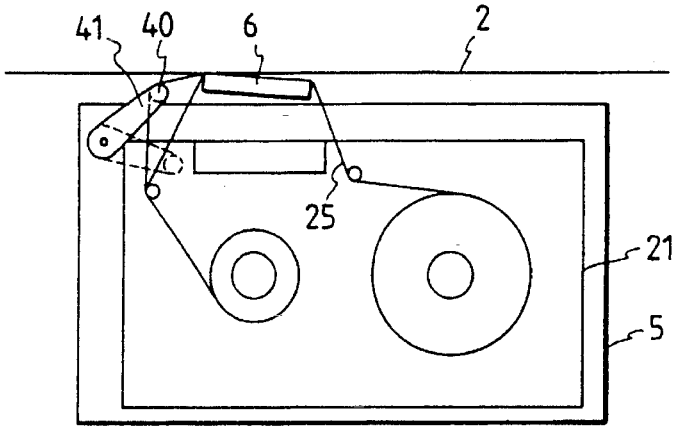
FIG. 17 PRIOR ART
FIG. 17 is a view explaining the case where cold peeling printing is performed in a conventional thermal transfer printer.
Figure 18:
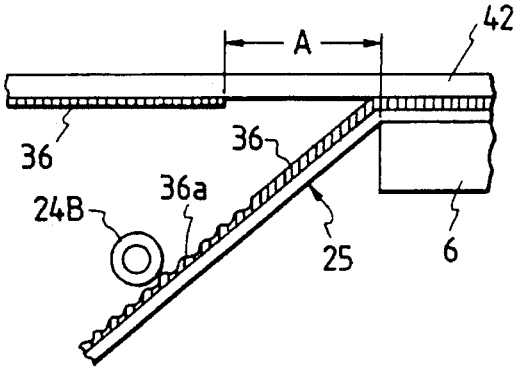
FIG. 18 PRIOR ART
FIG. 18 is a view explaining sticking to each other of the ink ribbon and the guide roller immediately after printing in a conventional thermal transfer printer.
Figure 19:
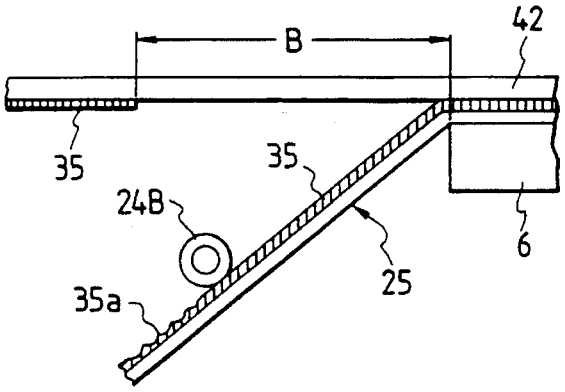
FIG. 19 PRIOR ART
FIG. 19 is a view explaining the feed amount of the ink ribbon for preventing sticking to each other of the ink ribbon and the guide roller immediately after printing in a conventional thermal transfer printer.

Further, as a third embodiment shown in FIG. 12, a feed gear 67*a* positioned coaxially with the second feed bobbin 67 through a friction mechanism may be provided. A drive gear 98 is disposed, which increases the load due to the friction mechanism and is meshed with the feed gear 67*a* and which is meshed with the teeth formed on the drive belt 51 to be rotated with traveling of the carriage 5. By suitably selecting the gear ratio between the drive gear 98 and the feed gear 67*a*, feeding amount of the ink ribbon 82 by the second feed bobbin 67 may be controlled to be smaller than traveling amount of the carriage 5. Thereby the feeding amount of the ink ribbon 82 may be made smaller and as a result the consumption of the ink ribbon may be reduced. Such control is suitable for the case of using a "multi-time" ribbon which may be used in printing for a plurality of times.

We claim:

1. A ribbon cassette mounted detachably with respect to an upper surface of a carriage of a thermal transfer printer, said thermal transfer printer having a plurality of detection switches arranged along a straight line on said upper surface of said carriage for detecting the presence of the ribbon cassette and for determining a type of ribbon stored in the cassette, said ribbon cassette comprising:

a case including parallel side walls, a back wall extending between said side walls, and a bottom wall;

a feed reel and a take-up reel rotatably mounted in said case;

an ink ribbon trained between said feed reel and said take-up reel; and a detection section including a plurality of detection holes formed on said lower wall of said case for engaging said plurality of detection switches disposed on the upper surface of the carriage of said thermal transfer printer, said detection section being formed at a position corresponding to an outermost circumference of a wound diameter of the ink ribbon wound on said take-up reel and said feed reel, said plurality of holes of the detection section being arranged diagonally with respect to the back wall and the side walls of the case such that the detection section aligns with the plurality of detection switches disposed on the upper surface of the carriage.

2. A ribbon cassette according to claim 1, wherein each of said plurality of detection holes are selectively coverable with a seal in accordance with a type of the ink ribbon contained in the case.

3. A ribbon cassette according to claim 2, wherein said plurality of detection holes are formed obliquely with respect to the back wall of the case.

* * * * *